US012103758B2

(12) United States Patent
Branch

(10) Patent No.: US 12,103,758 B2
(45) Date of Patent: Oct. 1, 2024

(54) BEVERAGE CONTAINER COVER DEVICE

(71) Applicant: Joshua W Branch, Athens, GA (US)

(72) Inventor: Joshua W Branch, Athens, GA (US)

( * ) Notice: Subject to any disclaimer, the term of this patent is extended or adjusted under 35 U.S.C. 154(b) by 138 days.

(21) Appl. No.: 17/465,688

(22) Filed: Sep. 2, 2021

(65) Prior Publication Data

US 2023/0065853 A1 Mar. 2, 2023

(51) Int. Cl.
*B65D 81/38* (2006.01)
*A47G 23/02* (2006.01)

(52) U.S. Cl.
CPC ..... *B65D 81/3881* (2013.01); *A47G 23/0216* (2013.01); *A47G 2023/0291* (2013.01)

(58) Field of Classification Search
CPC ..... A47G 2023/0291; B65D 81/3876; B65D 81/3879; B65D 81/3883; B65D 81/3881; B65D 81/3886; B65D 81/3888; B65D 81/389; B65D 81/3893; B65D 81/3895; B65D 81/3897
See application file for complete search history.

(56) References Cited

U.S. PATENT DOCUMENTS 10,030,903 B2 * 7/2018 Nguyen ..... F25D 3/08
2016/0270575 A1 * 9/2016 Panone ..... A47G 23/0216
2021/0267394 A1 * 9/2021 Nelson ..... B65D 81/3876

* cited by examiner

*Primary Examiner* — Javier A Pagan
(74) *Attorney, Agent, or Firm* — Smith Tempel Blaha LLC; Gregory Scott Smith

(57) ABSTRACT

A universal insulating beverage container cover device that expands to accommodate various sizes and shapes of beverage containers. The device is constructed of multiple panels of insulated material, such as stainless steel with double-wall vacuum insulation walls, that can expand and contract relative to each other depending on the size of the beverage container inserted into the container cover device. The bottom of the beverage container cover device also allows for expansion and contraction so that the size of the bottom of the drinking container can fit snuggly into the insulating beverage cover device as well.

5 Claims, 8 Drawing Sheets

BEVERAGE CONTAINER COVER DEVICE

BACKGROUND

Maybe it is just an "American" thing, or maybe it is more global, or maybe it is just an individual preference but, for those that like cold drinks, they tend to be obsessed with keeping the drink cold until it is finished. The coffee and tea drinkers are on the other end of the spectrum—wanting to keep their beverages hot. The desire, or obsession if you will, has created an entire and lucrative industry focused on keeping drinks cold that extends well beyond the action of pulling an ice-cold beverage from an ice-packed cooler. This obsession may have first reared its head as early as 1960 when the Dart Manufacturing Company in Mason Michigan introduced the first styrofoam cup. Today, the industry is jammed pack with items to keep cold drinks cold and hot drinks hot. These items include THERMOS brand containers, KOOZIE brand beverage covers, TERVIS brand insulated tumblers, YETI brand insulated cups, etc.

Most of these products are stand-a-lone products but the KOOZIE brand beverage covers, and similar products are more focused on insulating a beverage within its native container. As such, KOOZIE brand beverage covers, and similar products, are designed to slide over a standard sized can or bottle. Other companies have also gotten into the beverage container cover industry, such as YETI, with insulated products that can be slid over a standard sized beverage can or bottle.

A problem that faces the industry, especially in recent times, is that the concept of a "standard sized can or bottle" no longer exists. One trip to the local beverage store will present one with a plethora of different shaped and sized cans and bottles.

While KOOZIE style cloth, rubber, or flexible foam beverage container covers can be utilized for beverage containers of different sizes, they do not provide the level of insulation that is able to be attained by a thermally insulated container such as a THERMOS, TERVIS or YETI brand beverage container cover.

What is needed in the art is a slip-on beverage container cover that at minimum exceeds the insulation capabilities of KOOZIE branded and styled beverage container covers and rivals the insulation capabilities of THERMOS, TERVIS and YETI branded style covers but that can be applied to beverage containers of different shapes and sizes.

BRIEF SUMMARY

Embodiments of the present invention provide a universal insulating beverage container cover device that allows for the expansion of the device to accommodate various sizes and shapes of beverage containers. In various embodiments, this universal beverage container cover device is constructed of multiple panels of insulated material, such as stainless steel with double-wall vacuum insulation walls as a non-limiting example, that can expand and contract relative to each other depending on the size of the beverage container inserted into the container cover device. The bottom of the beverage container cover device also allows for expansion and contraction so that the size of the bottom of the drinking container can fit snuggly into the insulating beverage cover device as well.

An exemplary embodiment includes an insulating beverage container cover including aa horizontal panel having a substantially flat bottom surface and having an outside edge defining a shape and a wall attached to the outside edge of the horizontal panel. The wall includes a plurality of elements with each element, employing the use of an expandable connector, being attached to each adjacent element of the plurality of elements. A void is defined by the horizontal panel and wall, wherein the void is configured to receive a beverage container. In such an embodiment, the void is at a first volume at rest and a second volume when a beverage container of a first size in inserted into the void thereby forcing the plurality of elements to move away from each adjacent element.

In various embodiments, each of the elements or a portion of the elements of the plurality of elements ma be insulated. For instance, in some embodiments, the elements may be fabricated of stainless steel and include a double-wall vacuum insulation.

In various embodiments, the expandable connector is a sliding tongue and groove connector. In other embodiments, the expandable connector is an insulated material with a level of elasticity. In yet other embodiments, the expandable connector is a combination of a sliding tongue and groove connector and an elastic material. In yet other embodiments, the expandable connector is a sliding tongue and groove connector with a spring.

In some embodiments of the insulation beverage container cover, the insulating elements may overlap with adjacent elements and an elastic material can be used to bias each element of the plurality of elements towards each adjacent element.

Further, in various embodiments, the horizontal panel may also include a plurality of elements with each element, employing the use of an expandable connector, being attached to each adjacent element of the second plurality of elements. In such embodiment, the elements of the wall and the horizontal panel may be insulated. For instance, the panels of both the wall and horizontal panel may be fabricated of stainless steel and includes a double-wall vacuum insulation, and the expandable connector can be of a sliding tongue and groove connector and/or an insulated material with a level of elasticity.

In an exemplary embodiment of the insulation beverage container the shape of the horizontal panel is round, however other shapes may also be utilized. In various embodiments the void can be expanded to hold a container up to a maximum size limited by the distance that the expandable connectors can move. In some embodiments of insulation beverage container, the plurality of elements for the wall may include two more elements horizontally oriented with respect to each other and two or more elements vertically oriented with respect to each other. Further, in some embodiments only vertically oriented elements or horizontally oriented elements may be used. Further in other embodiments the elements for the wall may include two or more rows of elements and two or more columns of elements.

These embodiments as well as other embodiments are further addressed in the detailed description that follows and the drawings.

DETAILED DESCRIPTION OF EMBODIMENTS

The present invention, as well as features and aspects thereof, is directed towards providing a beverage container cover device that can be utilized on containers of various sizes and provide insulation to the contents of the containers.

As the embodiments of the present invention are directed towards a universal insulating beverage container device that allows for the expansion of the device so as to accommodate various sizes of beverages. This universal beverage container device is made multiple panels of stainless steel with double-wall vacuum insulation that expand and contract depending on the size of the beverage inserted into the container device. The bottom of the device allows for expansion and contraction so that the size of the bottom of the drinking container can fit snuggly into the insulating beverage device as well.

Figure 1:
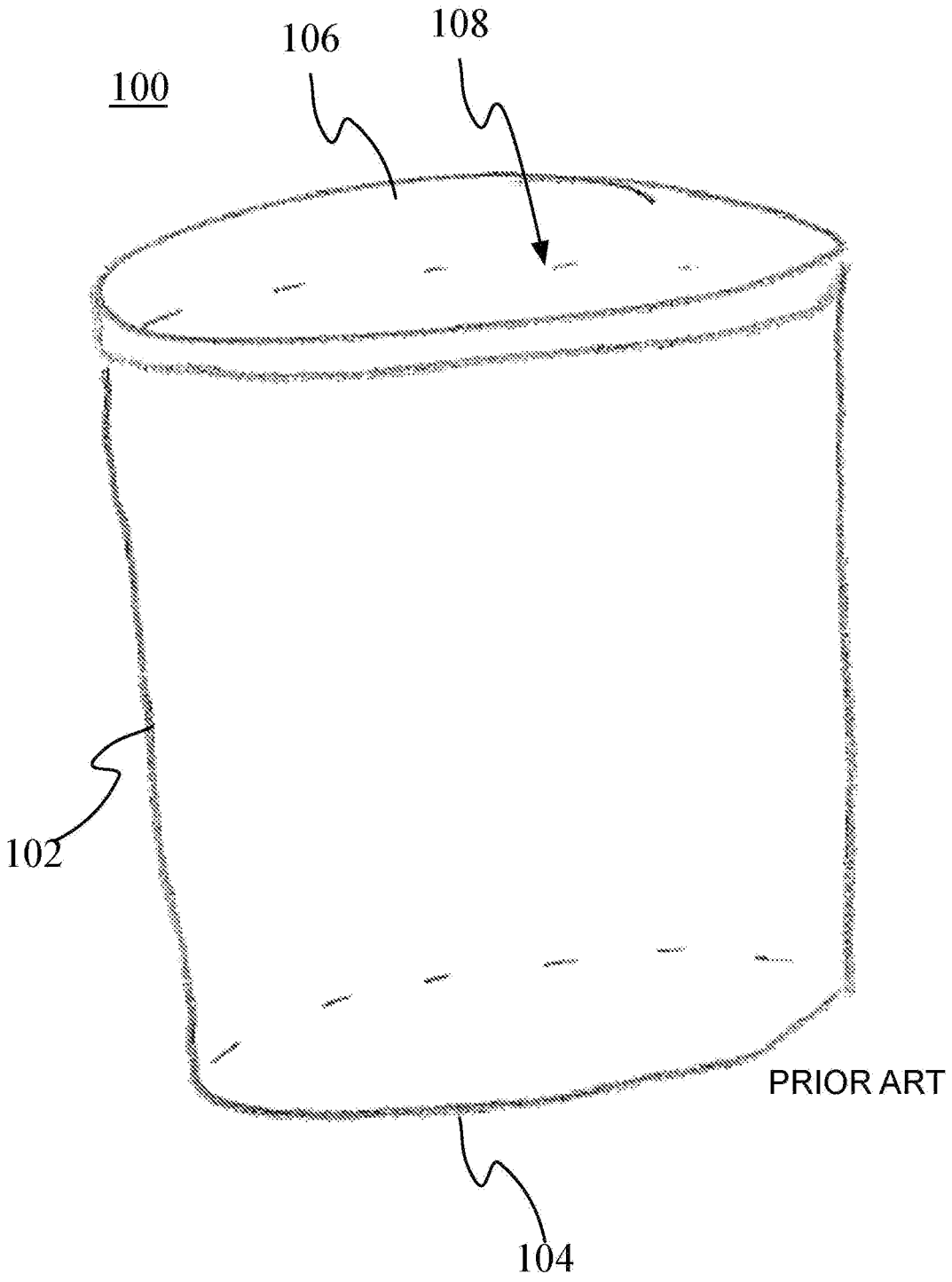
FIG. 1 is a conceptual drawing of a prior art beverage container cover device.

FIG. 1 is a conceptual drawing of a prior art beverage container cover device. The beverage container cover device includes a cover 100 that consists of a side wall 102 and a lower horizontal panel 104. The beverage container cover device 100 also includes an opening 106 for receiving a beverage container (not shown) into a void 108 defined by the side wall 102 and lower horizontal panel or bottom 104.

Figure 2:
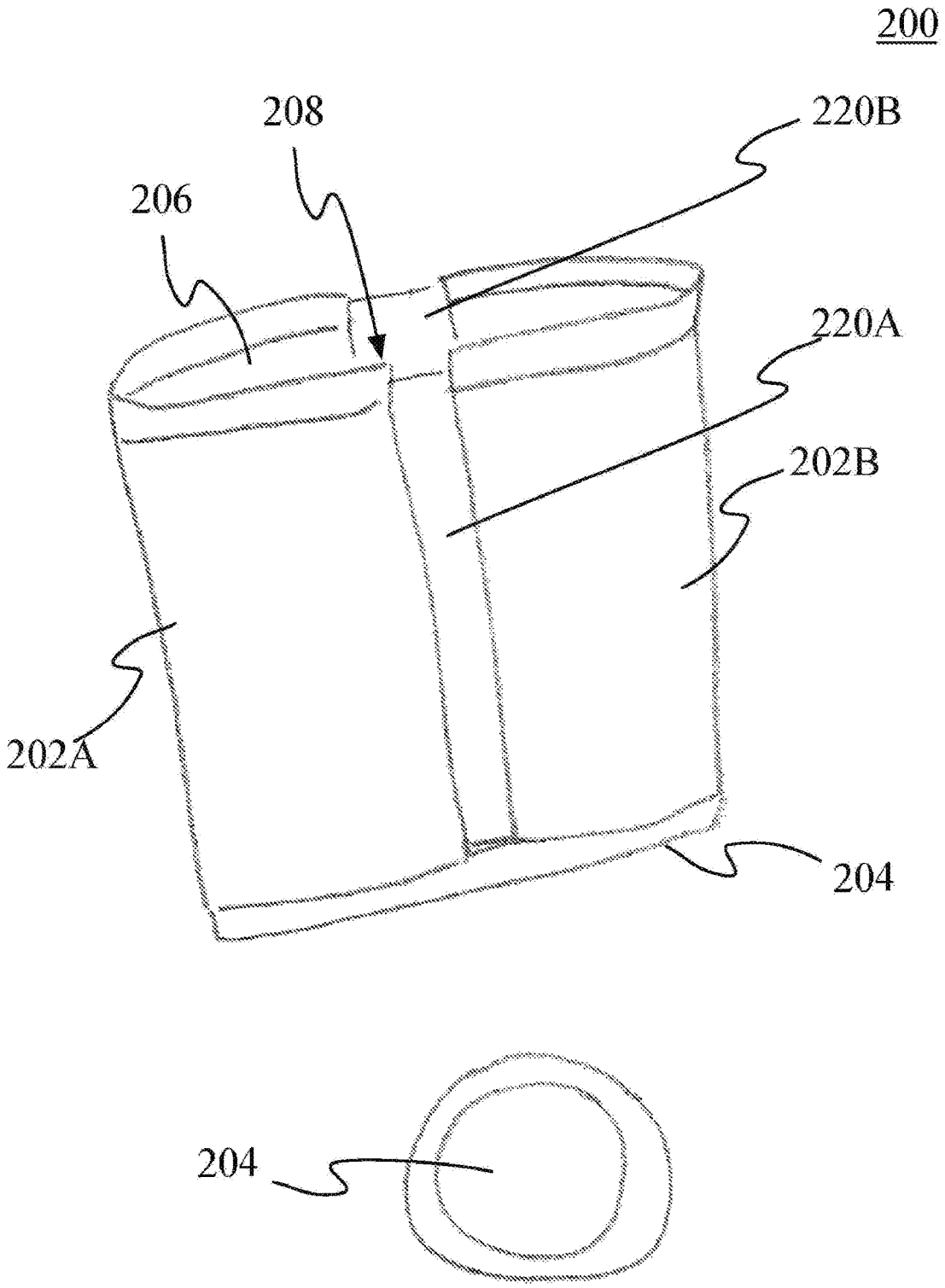
FIG. 2 is a conceptual drawing of a two-piece embodiment of a beverage container cover device.

FIG. 2 is a conceptual drawing of a two-piece embodiment of a beverage container cover device. In the illustrated embodiment, the beverage container cover device 200 includes a first side 202A and a second side 202B that are connected to each other utilizing an expandable material 220A and 220B. In the illustrated embodiment, the first side element 202A is connected along two vertical edges to two vertical edges of a second side element 202B utilizing an expandable connector 220A and 220B. A bottom edge of the first side element 202A and the second side element 202B is connected to a lower horizontal panel 204. The first side 202A, the second side 202B and the lower horizontal panel 204 collectively define a void 208 for receiving a beverage container (not illustrated) through an opening defined by the first side 202A and second side 202B. In this embodiment, the expandable connector 220A and 220B allows the beverage container cover device 200 to receive containers of various sizes ranging from a minimum size to a maximum size. The minimum size would be a size that snuggly fits into an unexpanded void 208 (i.e., when the cover device is at rest) whereas the maximum size would be the maximize size of the void 208 that can be created by the expandable connectors 220A and 220B expanding out to their maximum extension while still maintaining elasticity.

Figure 3:
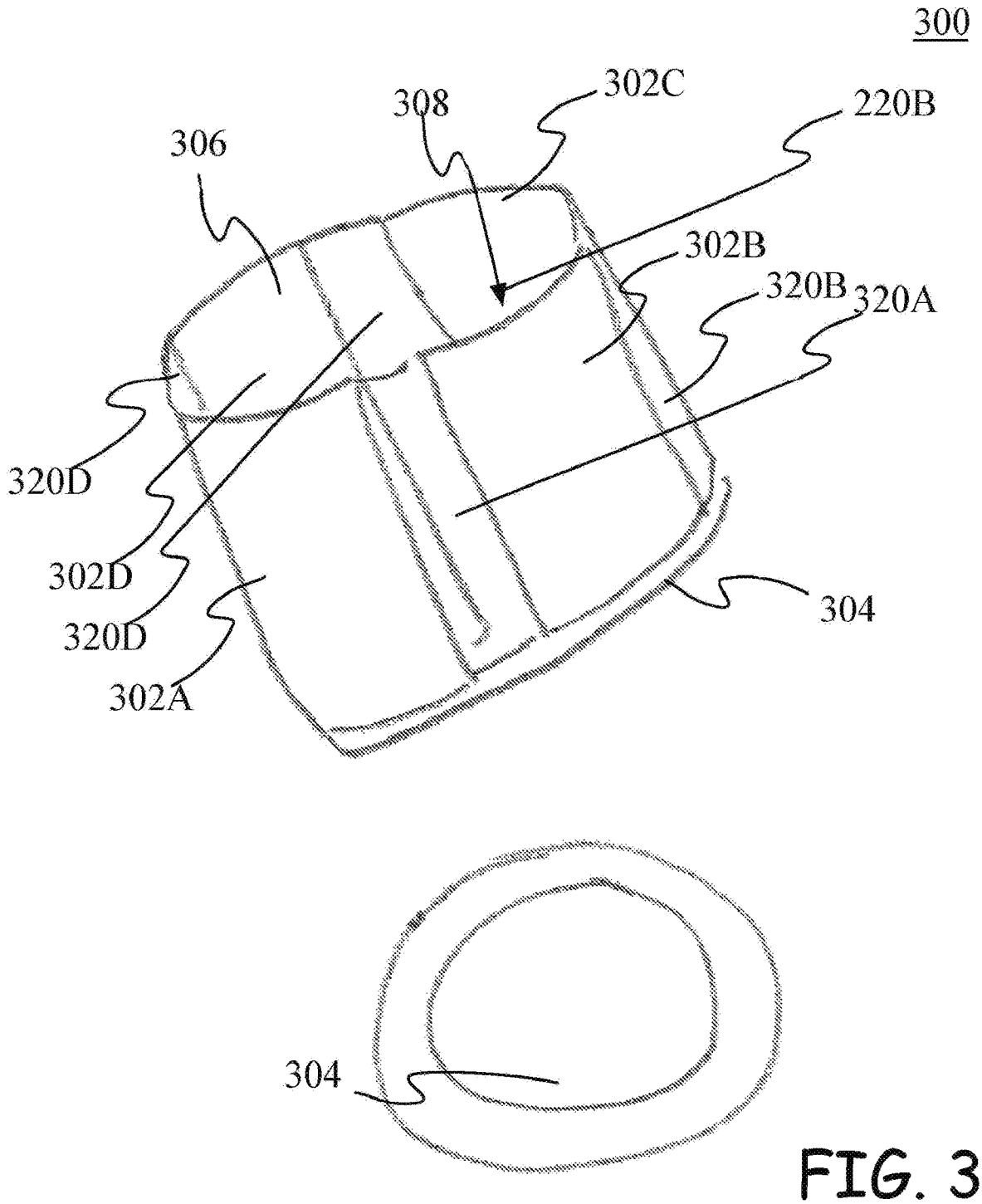
FIG. 3 is a conceptual drawing of a four-piece embodiment of a beverage container cover device.

FIG. 3 is a conceptual drawing of a four-piece embodiment of a beverage container cover device. In the illustrated embodiment, the beverage container cover device 300 includes a first panel 302A, a second panel 302B, a third panel 302C and a fourth panel 302D. Each of the panels 302A-302D are connected to each other utilizing an expandable connector 320. A vertical side of the first panel 302A is connected to a vertical side of second panel 302B using expansion connector 320A. Likewise, a vertical side of the second panel 302B is connected to a vertical side of the third panel 302C using expansion connector 320B, a vertical side of the third panel 302C is connected to a vertical side of the fourth panel 302D using expansion connector 320C and a vertical side of the fourth panel 302D is connected to a vertical side of the first panel 302A using expansion connector 320D. A bottom edge of the panels 302A-D is connected to a lower horizontal panel 304. The first panel 302A, the second panel 302B, the third panel 302C, the fourth panel 302D and the lower horizontal panel 304 collectively define a void 308 for receiving a beverage container (not illustrated) through an opening defined by the panels 302A-D. In this embodiment, the expandable connectors 320A-D allow the beverage container cover device 300 to receive containers of various sizes ranging from a minimum size to a maximum size. The minimum size would be a size that snuggly fits into an unexpanded void 308 whereas the maximum size would be the maximize size of the void 308 that can be created by the expandable connectors 320A-D expanding out to their maximum extension while still maintaining elasticity.

Figure 4:
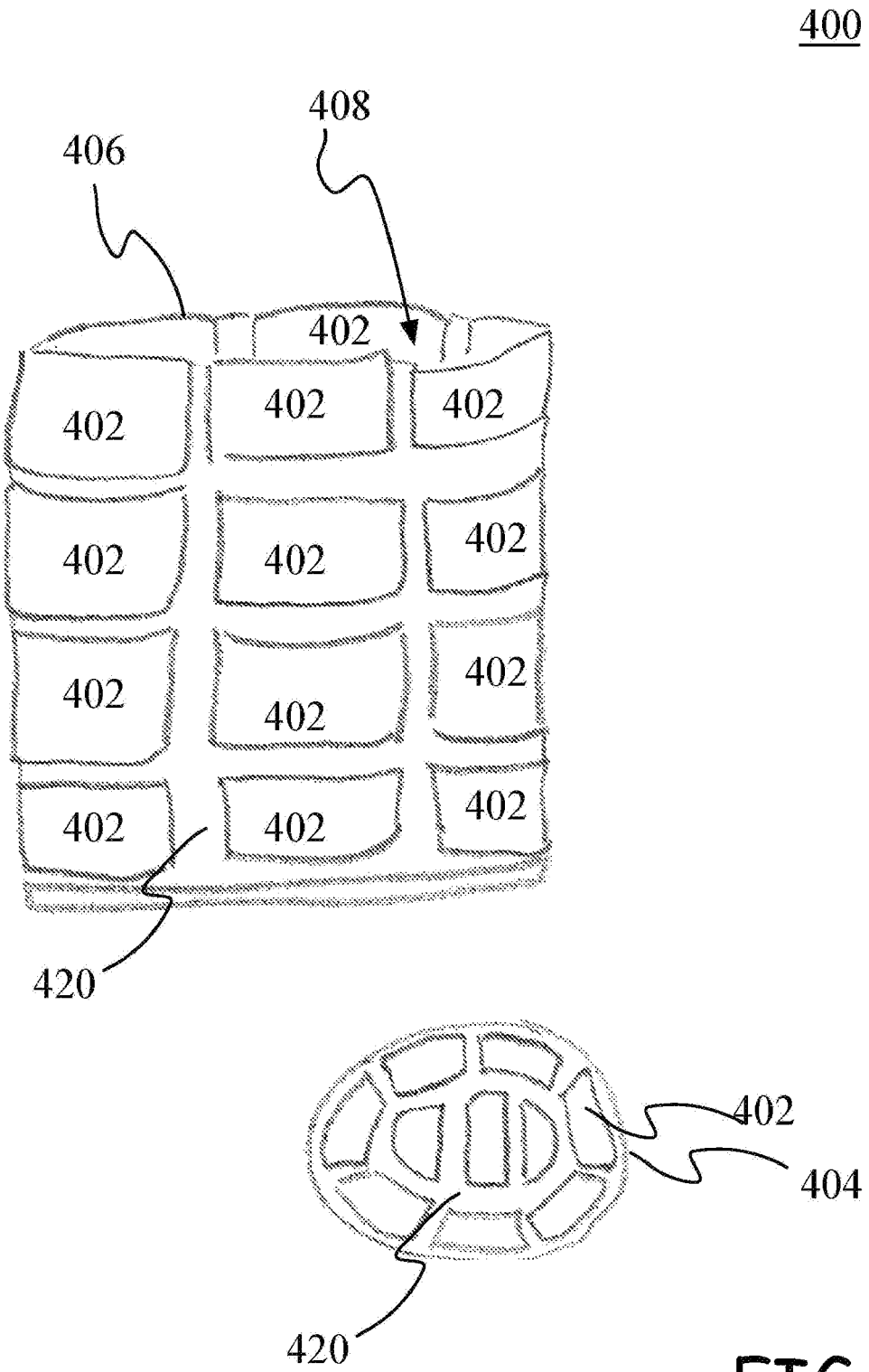
FIG. 4 is a conceptual drawing of a multi-piece and multi-directional expansion embodiment of a beverage container.

FIG. 4 is a conceptual drawing of a multi-piece and multi-directional expansion embodiment of a beverage container cover device. In the illustrated embodiment, the beverage container cover device 400 includes several panels 402 arranged to form a wall 406 that is cylindrical in shape; however, it will be appreciated that other shapes may be employed as well. Each of the panels 402 are connected to adjacent panels 402 utilizing an expandable connector 420. The panels 402 are connected in an array form and in the illustrated embodiment, the array is cylindrically shaped and is 6 panels wide (or in circumference) and 4 panels high.

In one embodiment, the panels 402 can be connected to a beverage container cover made from the expandable material. In such an embodiment, the panels 402 could be glued, sewn, heat welded or using some other technique to fasten the panels to the cover. In other embodiments, the panels 402 can be attached to each other using an expandable connector or expandable material. The expandable connector in such embodiments can be connected between the edges of the various panels 402. The beverage container cover device 400 also includes a bottom that also includes a plurality of panels 402, each connected similarly to the panels 402 in the cylindrical wall 406. The cylindrical wall 406 and the bottom panel 408 form a void for receiving a beverage container (not illustrated) through an opening defined by the cylindrical wall 406. In this embodiment, the expandable connector consisting of an expandable material 420 allows the beverage container cover device 400 to receive containers of various sizes ranging from a minimum size to a maximum size. The minimum size would be a size that snuggly fits into an unexpanded void 408 whereas the maximum size would be the maximize size of the void 408 that can be created by the expandable material 410 expanding out to their maximum extension while still maintaining elasticity. Further, in the illustrated embodiment, it should be appreciated that the cylindrical wall can expand in any direction and the bottom 408 is also able to expand. Further, it should be appreciated that in a cylindrical array embodiment as the one illustrated in FIG. 4, the cylindrical wall 406 may actually conform to the shape of the beverage container being inserted into the void of the beverage container cover device 400. Advantageously, with the cylindrical wall 406 conforming to the shape of the container, better insulation can be attained.

Figure 5A:
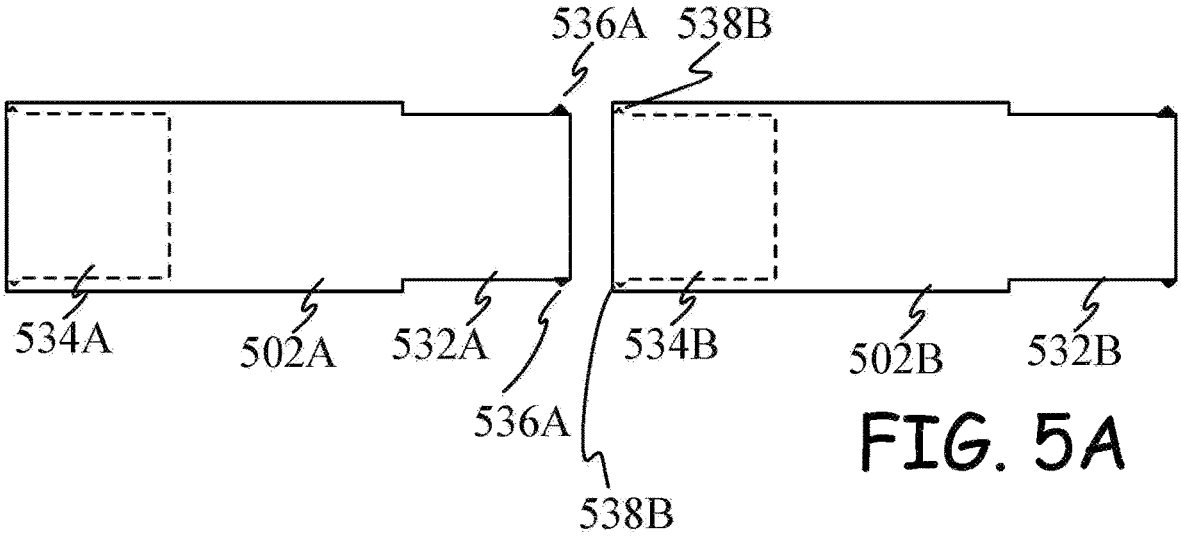
FIG. 5A is a conceptual diagram of one technique to provide expansion of an embodiment of a beverage container cover device in a first state.
Figure 5B:
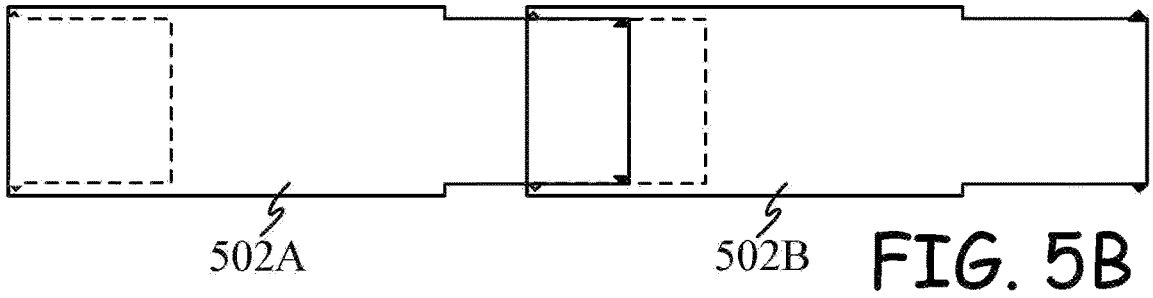
FIG. 5B is a conceptual diagram of one technique to provide expansion of an embodiment of a beverage container cover device in a second state.
Figure 5C:
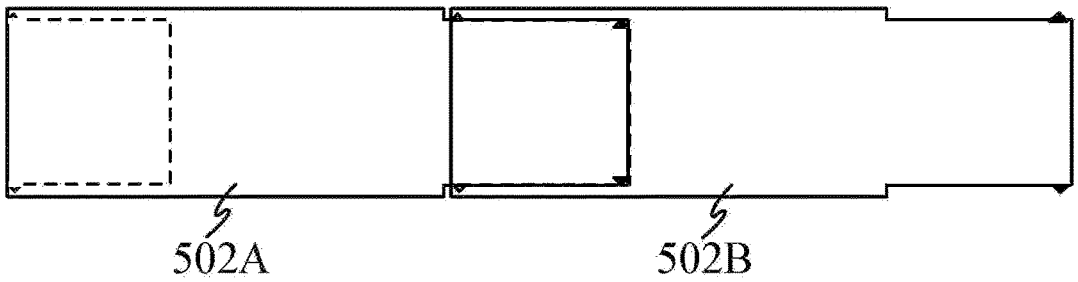
FIG. 5C is a conceptual diagram of one technique to provide expansion of an embodiment of a beverage container cover device in a third state.

FIGS. 5A-C are conceptual diagrams of one technique to provide expansion of an embodiment of a beverage container cover device. The embodiments illustrated thus far focus on the use of an expandable material between insulated panels. It should be understood that the insulating panels may be fabricated from a wide variety of materials including stainless steel, aluminum, glass, other metal, plastics, composites, organic, etc. as non-limiting examples. Likewise, the expandable material may also be manufactured out of a variety of materials but, preferably, a material that allows or provides some level of insulation in addition to allowing the expansion. One embodiment for the insulated panels may be a two-walled metallic material with a vacuum between the walls. Such an embodiment is what is anticipated in FIGS. 5A-5C. Here, the insulating panels 502 interlock with each other in a sliding fashion, thus eliminating the need for the expandable material. Looking at FIG. 5A, a first insulating panel 502A includes an insert or tongue 532A and a receptor 534B. The entire panel 502A is fabricated from an insulating material. In operation, the tongue 532A can be inserted into the receptor 534B of insulating panel 502B. The tongue 532A includes two protrusions 536A or some other locking mechanism that corresponds with detent 538B in panel 502B. Thus, as the tongue 532A is slid into the receptor 534B, it locks into position when the protrusions 536A align with the detents 538B. This prevents or reduces the risk that the panel 502A will be disconnected from the panel 502B. The tongue 532A can be further pushed in the receptor 534B (see FIG. 5B) to reduce the size of the beverage container cover device. It should be appreciated that multiple detents 538B and or protrusions 536A could be utilized to secure panel 502A and 502B into positions relative to each other.

In some embodiments, the tongue 532 and/or the receptor 534 may be coated with an insulating material to provide further insulation. The tongue may be pushed all the way into the receptor 534 as in FIG. 5C. As such, the sliding of the tongue 532 in and out of the receptor 534 allows a beverage container cover device constructed of such panels to expand or contract to hold the beverage container. It should be appreciated that in come embodiments, a spring, elastic or some other force can be employed to pull or bias the tongue 532 into the receptor 534.

In some embodiments, the receptor 534B may be a hollowed-out void that receives the tongue 532A. In other embodiments, the receptor 534B may be a rail or track, similar to a kitchen drawer, that mates with the tongue 532A and allows the tongue 532A to slide between the positions illustrated in FIG. 5A-5C.

Figure 6A:
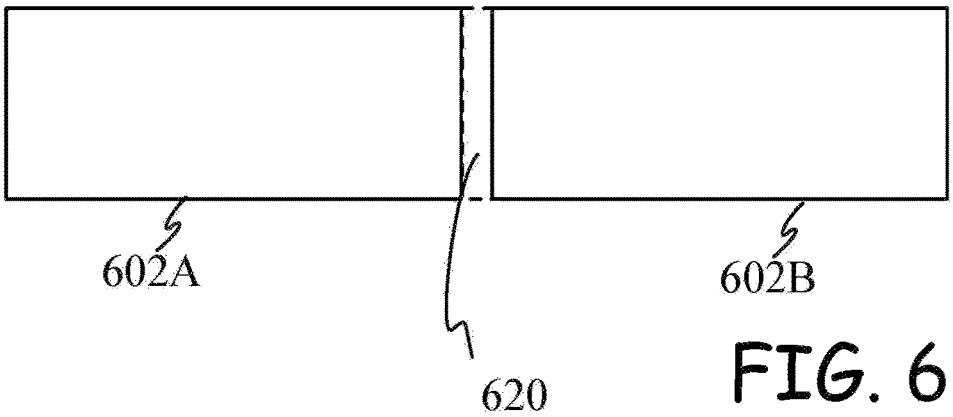
FIG. 6A is a conceptual diagram of another technique to provide expansion of embodiments of a beverage container cover device in a first state.
Figure 6B:
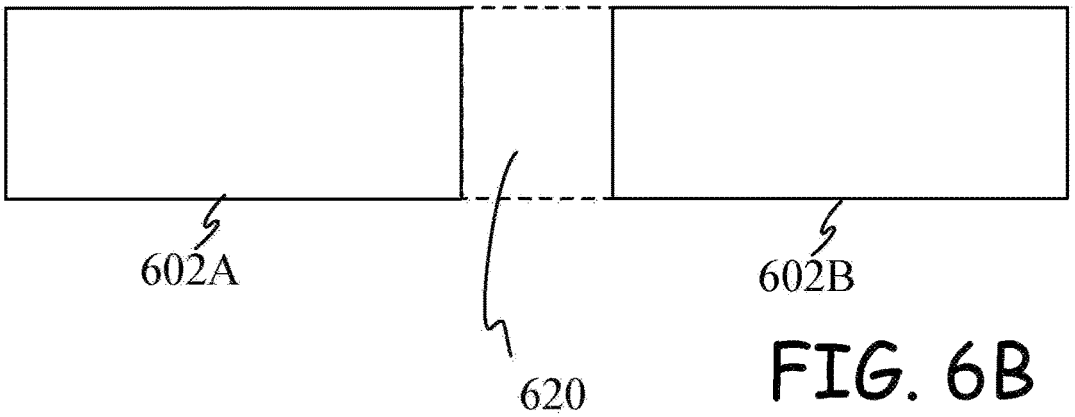
FIG. 6B is a conceptual diagram of another technique to provide expansion of embodiments of a beverage container cover device in a second state.
Figure 6C:
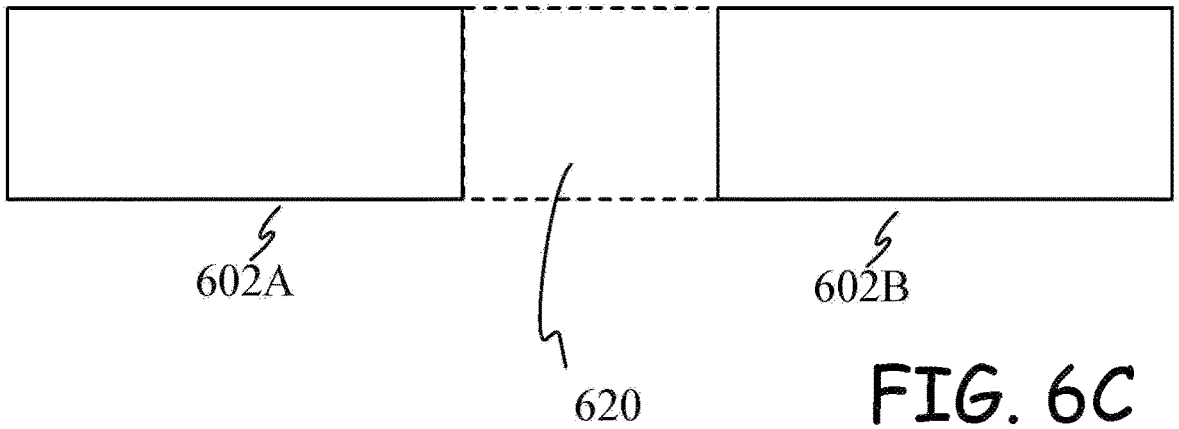
FIG. 6C is a conceptual diagram of another technique to provide expansion of embodiments of a beverage container cover device in a third state.

FIG. 6 is a conceptual diagram of another technique to provide expansion of embodiment of a beverage container cover device. In the illustrated embodiment, the panels 602 may fabricated from a wide variety of materials including stainless steel, aluminum, glass, other metal, plastics, composites, organic, etc. as non-limiting examples. Likewise, the expandable material may also be manufactured out of a variety of materials but, preferably, a material that allows or provides some level of insulation. One embodiment for the insulated panels may be a two-walled metallic material with a vacuum between the walls. Such an embodiment is what is anticipated in FIGS. 6A-6C. Here, the insulating panels 602 are attached to adjacent insulating panels using an expandable material 620. Looking at FIG. 6A, a first insulating panel 602A and a second insulating panel 602B are fabricated from an insulating material. In operation, the attached insulating panels are drawn together or biased toward each other due to a force asserted by the expandable material 620. A beverage container fabricated with such a structure, when receiving a container, expands to allow the cover to slid over the container. It should be appreciated that in some embodiments, the expandable material 620 may gain its elasticity from use of a spring, elastic, silicon or some other force to pull the panels together. As a container is inserted into a beverage container cover device so constructed, the panels are forced away from each other, such as is illustrated in FIG. 6B and FIG. 6C. The expandable material 620 maintains a bias on the two panels 602A and 602B such that when the container is removed, the panels again are drawn together to the state illustrated in FIG. 6A.

Figure 7:
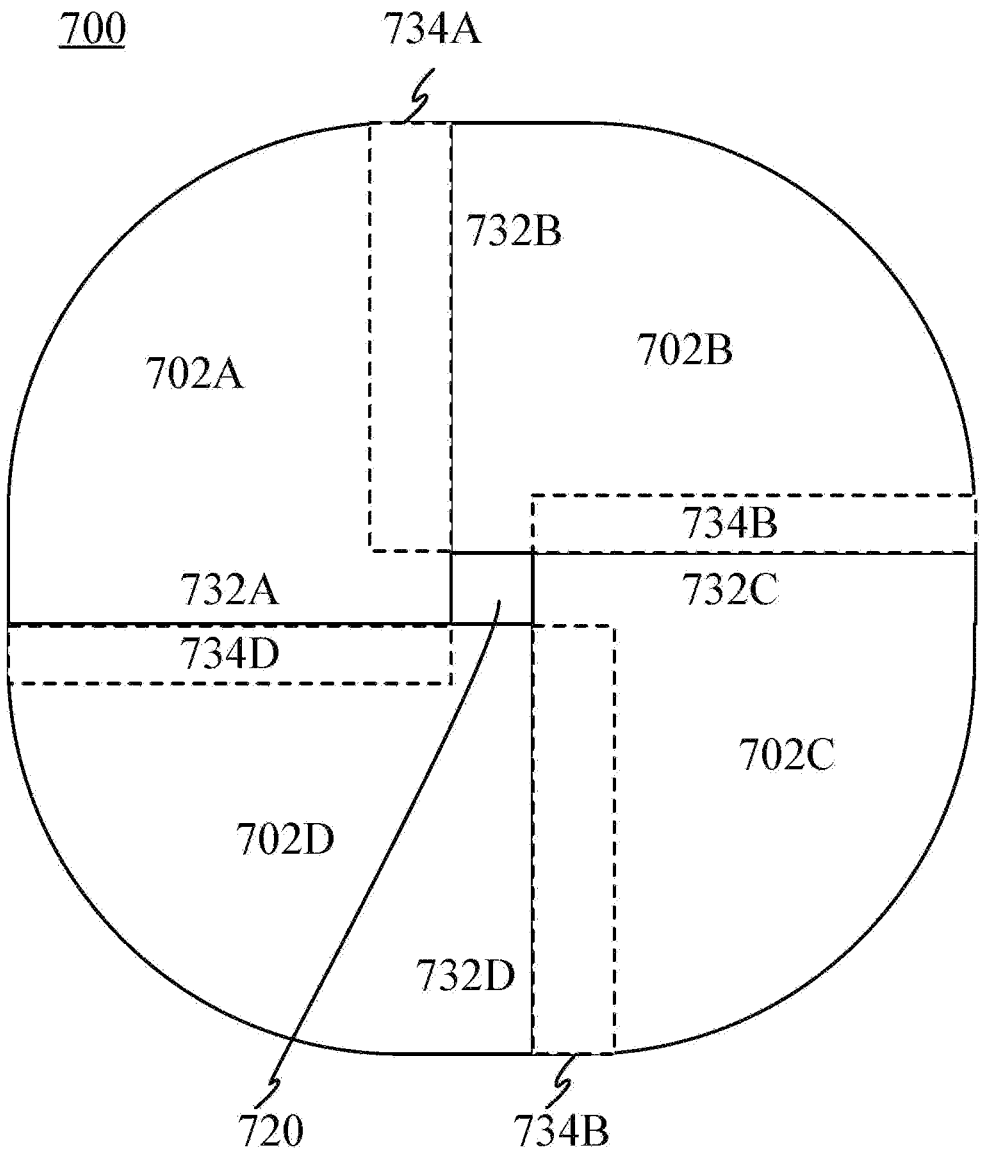
FIG. 7 is a conceptual diagram of an embodiment of a beverage container cover device bottom.

FIG. 7 is a conceptual diagram of an embodiment of a beverage container cover device bottom. The illustrated bottom may be attached to any of the wall embodiments described herein as well as variants thereof. In the illustrated embodiment, the bottom of the beverage container cover device 704 includes 4 panel 702A-702D. The panels 702A-702D are constructed similarly to the tongue and slide groove receptor construction of FIG. 5. However, it will be appreciated that expansion material or other techniques may also be used. In the illustrated embodiment, each panel 702A-702D includes a tongue 732A-732D respectively. Further, each of the panels 702A-702D also include a receptor 734A-734D respectively. In the illustrated embodiment, the tongue 732A is illustrated as being associated with receptor 734D, tongue 732B is associated with receptor 734A, tongue 734C is associated with receptor 734B and tongue 732D is associated with receptor 734B. The bottom 700 is illustrated as being in an expanded state with the tongues 732A-732D retracted from their associated receptors 734D, 734A, 734B and 734C respectively. A spring or elastic material can be used to encourage or bias the panels towards each other or back together. Further a single expandable material element 720 may be utilized in the illustrated embodiment to fill in the center of the bottom.

Figure 8:
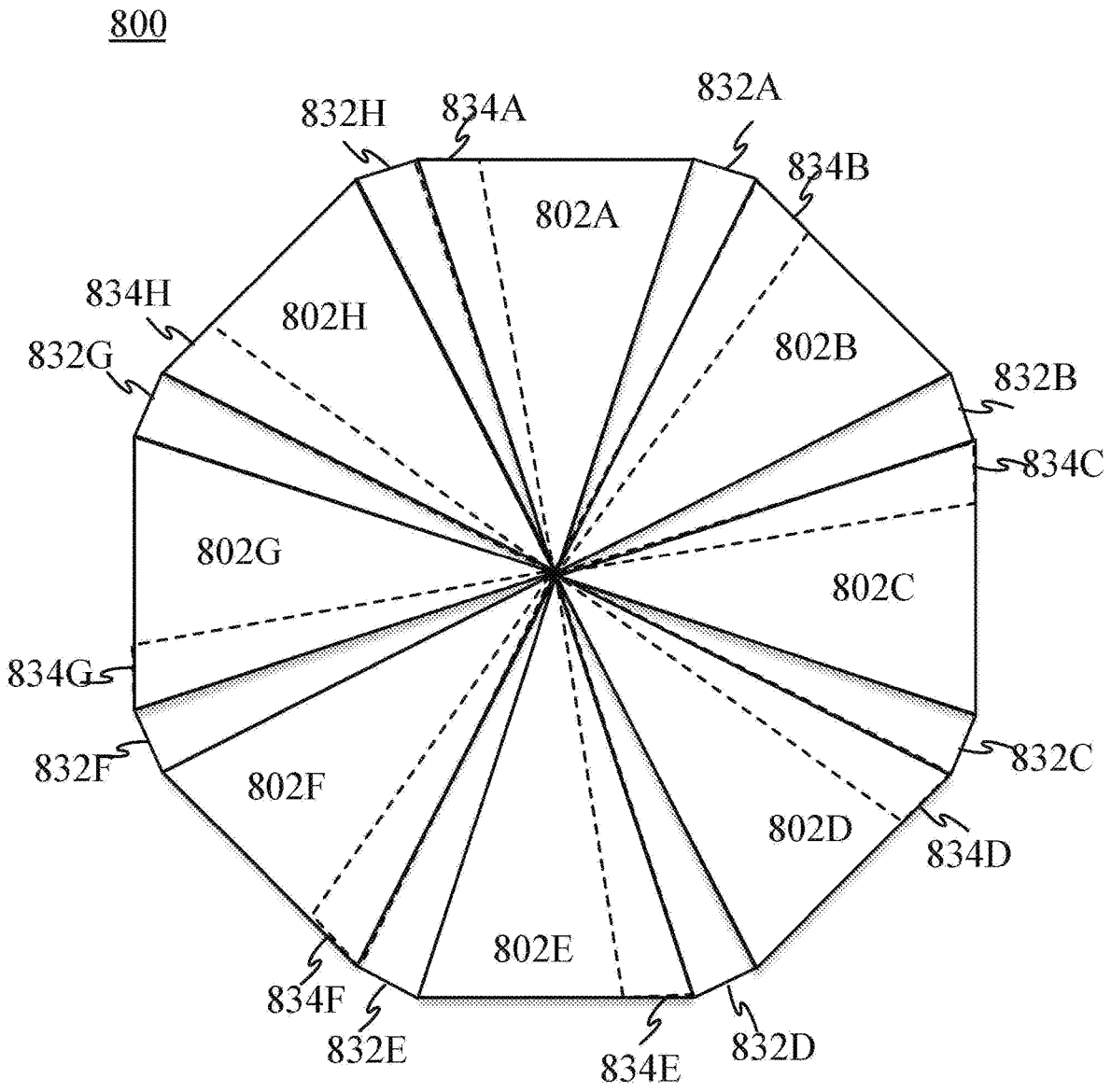
FIG. 8 is a conceptual diagram of another embodiment of a beverage container cover device bottom.

FIG. 8 is a conceptual diagram of another embodiment of a beverage container cover device bottom. The illustrated bottom includes 8 panels 802A-802H and is illustrated as including the tongue and receptor structure of FIG. 5. However, it will be appreciated that expansion material or other techniques may also be used. In the illustration, the panels 802A-802H are illustrated as being fully expanded. A spring, elastic or other mechanism may be used to draw the panels 802A-802H into a retracted position in which tongues 832A-832H would be drawn into receptors 834B, C, D, E, F, G, H, and A respectively.

Different embodiments may be constructed in different shapes and sizes. Embodiments may include varying numbers of panels and techniques to draw the panels into a closed or non-expanded state. In some embodiments of the tongue and receptor structure, the tongue may be the same material and be insulated similarly to the panels. In other embodiments, the tongues may be a different, more pliable, bendable, stretchable, etc. material, such as rubber, silicone, plastic, etc. In some embodiments insulating gel may be used. Some embodiments will allow for expansion vertically (Y-axis), some horizontally (X-axis), some diagonally (Z-axis) and some in a combination of two or more such directions. The panels can be of a uniform shape and size or of varying shapes and sizes.

The illustrated embodiments have been shown as being cylindrical, such as for holding a can. However, it will be appreciated that the various embodiments may take on a variety of shapes and receive a variety of container shapes without departing from the spirit and scope of the present invention.

In some embodiments, multiple layers of panels may be utilized with the panels being staggered from each other to facilitate minimizing an air path or fluid path to the surface side of the beverage container.

It will also be appreciated that in embodiments such as those shown in FIGS. 5, 7 and 8, rather than having a tongue associated with one panel and a receptor with an adjacent panel, the panels may simply include receptors and rather than a tongue, a second panel may be used to slide into and out of both of the receptors of the adjacent panels. Thus, a panel with tongues on two or more sides may be positioned between panels with receptors on both sides.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An insulating beverage container cover comprising:

a horizontal panel having a substantially flat bottom surface and having an outside edge defining a shape;

a wall attached to the outside edge of the horizontal panel, the wall comprising a plurality of elements with each element, employing the use of an expandable connector, being attached to each adjacent element of the plurality of elements, and wherein each of the elements of the plurality of elements is insulated;

a void defined by the horizontal panel and wall, wherein the void is configured to receive a beverage container; and wherein, the void is at a first volume at rest and a second volume when a beverage container of a first size in inserted into the void thereby forcing the plurality of elements to move away from each adjacent element;

wherein the horizontal panel comprises a second plurality of elements, wherein each element of the second plurality of elements, employing the use of an expandable connector, being attached to each adjacent element of the second plurality of elements.

2. The insulating beverage container cover of claim 1, wherein each of the elements of the plurality of elements and the second plurality of elements is insulated.

3. The insulating beverage container cover of claim 2, wherein each of the elements of the plurality of elements and the second plurality of elements is fabricated of stainless steel and includes a double-wall vacuum insulation.

4. The insulating beverage container cover of claim 3, wherein the expandable connector is an insulated material with a level of elasticity.

5. The insulation beverage container cover of claim 3, wherein each element of the plurality of elements overlaps with adjacent elements and an elastic material is used to bias each element of the plurality of elements towards each adjacent element.

* * * * *